US012180804B2

(12) United States Patent
Laun

(10) Patent No.: US 12,180,804 B2
(45) Date of Patent: Dec. 31, 2024

(54) CEMENT PLUG AND METHODS OF USE

(71) Applicant: Canadian Casing Accessories Inc., Calgary (CA)

(72) Inventor: Lyle Laun, Calgary (CA)

(73) Assignee: Canadian Casing Accessories Inc., Alberta (CA)

( * ) Notice: Subject to any disclaimer, the term of this patent is extended or adjusted under 35 U.S.C. 154(b) by 0 days.

(21) Appl. No.: 18/377,333

(22) Filed: Oct. 6, 2023

(65) Prior Publication Data

US 2024/0117705 A1 Apr. 11, 2024

Related U.S. Application Data

(60) Provisional application No. 63/414,610, filed on Oct. 10, 2022.

(51) Int. Cl.
*E21B 33/16* (2006.01)

(52) U.S. Cl.
CPC ..... *E21B 33/16* (2013.01)

(58) Field of Classification Search
CPC ..... E21B 33/16; E21B 33/165
See application file for complete search history.

(56) References Cited

U.S. PATENT DOCUMENTS

| | | | | |
|---|---|---|---|---|
| 4,986,361 | A * | 1/1991 | Mueller | E21B 23/08 166/381 |
| 5,762,139 | A * | 6/1998 | Sullaway | E21B 33/16 166/291 |
| 10,954,740 | B2 * | 3/2021 | Budde | E21B 33/165 |
| 2013/0014948 | A1 | 1/2013 | Gambier | |
| 2017/0067304 | A1 * | 3/2017 | Turley | E21B 33/134 |
| 2018/0112487 | A1 * | 4/2018 | Budde | E21B 33/165 |
| 2022/0220821 | A1 * | 7/2022 | Budde | E21B 33/16 |
| 2023/0048084 | A1 * | 2/2023 | Alluhaydan | E21B 37/02 |

* cited by examiner

*Primary Examiner* — David Carroll
(74) *Attorney, Agent, or Firm* — Russell Manning, FisherBroyles, LLP

(57) ABSTRACT

Embodiments are directed to improved apparatus and methods of use in the oil and gas industry and, more particularly, to downhole plugs such as cement plugs. The present cement plugs may be temporarily positioned at predetermined locations within a casing string, and form at least one annular wiper fin having at least one expansion member configured for biasing the at least one wiper fin radially outwardly and into sealing engagement with the inner surface of the casing string.

17 Claims, 18 Drawing Sheets

CEMENT PLUG AND METHODS OF USE

CROSS REFERENCE TO RELATED APPLICATIONS

This application claims the benefit of priority to U.S. Provisional Patent Application Nos. 63/414,610 filed Oct. 10, 2022 entitled "Improved Cement Plug and Methods of Use", which are specifically incorporated by reference herein for all that it discloses or teaches.

FIELD

Embodiments herein are generally related to improved apparatus for use in the oil and gas industry and, more particularly, to downhole plugs such as cement plugs.

BACKGROUND

During the drilling of a wellbore into a subterranean hydrocarbon formation, it is desirable to stabilize the wellbore by introducing multiple layers of steel pipe or 'casing' of varying diameters downhole, the outermost to innermost layers of casing known as conductor casing, surface casing, intermediate casing, and production casing, respectively.

Casing can be joined end-to-end and run downhole as 'casing string' to different depths depending on its function. For example, the outermost conductor casing typically extends from the surface to a predetermined first 'casing point' to protect the loose near-surface formation. Surface casing extends past the conductor casing point to provide both pressure integrity and structural strength, such that intermediate and/or production casing strings can be suspended therefrom further into the formation. Depending on various parameters, one or more intermediate and/or production casing strings may be installed from the surface casing all the way to the production zone.

In order to stabilize the wellbore, each casing string must be cemented in place. Cementing procedures involve pumping a cement slurry through the inside and out from the bottom of each casing until it circulates up into the annulus, forming a cement sheath around the casing. Prior to introducing the cement slurry into the casing, the casing may contain drilling mud or other servicing fluids that could contaminate the cement slurry. To prevent this contamination, one or more cementing plugs can be introduced into the casing ahead of the cement slurry to displace any mud or fluids from within the casing and to form a barrier preventing comingling of the slurry with the fluids.

Once the cement slurry has been pumped through the casing and into the annular space between the casing and the wellbore, displacement fluids are used to clean any residual cement from the casing. To prevent contamination of the cement slurry by such displacement fluids, however, one or more additional cement plugs can be introduced into the casing ahead of the fluids to displace any cement from within the casing and to form a barrier preventing comingling of the fluids with the slurry while the slurry is being circulated downhole and/or while the slurry it sets. Once in the annular space, the cement slurry sets to form an annular sheath of hardened, substantially impermeable cement that bonds and stabilizes the casing string to the wellbore.

Problems can arise, however, where the cement plugs fail to adequately isolate the cement from the displacement fluids. In such cases, cement slurry can bypass the cement plug and solidify within the string, creating a solid obstruction (referred to as a "cement stringer") within the wellbore that is not displaced. Cement stringers prevent downhole equipment, including the bottom hole assembly (BHA) from freely traveling to the toe of the well and interference with post-cementing operations (e.g., fracturing operations).

Multiple cement stringers can occur in the wellbore and often form near the toe of the horizontal portion of the well. Some attempts to remove cement stringers involve well intervention using coiled tubing, where a drift mill driven by a motor is run downhole until the full inside diameter of the casing has been restored. Such intervention is time consuming and costly.

Other attempts to remove cement stringers involve pumping high flow rate abrasive sand slurries downhole during fracturing operations. Such processes require that the completion contain toe ports that can support the high flow rates. Moreover, such processes fail to provide any confirmation that the cement stringers have been removed. It is imperative that operators determine whether the wellbore is clear of cement stringers and, as a result, intervention work is often performed even when no cement stringers exist.

Cement stringers can arise due to wear and tear on the fins of a cement plug fins as it is pumped downhole. For example, contact pressure and/or contact surface area between the fins and the casing string can be reduced or even lost before the plug arrives at the toe of the well, resulting in a failure of the plug to isolate the cement (below the plug) from the displacement fluids (above the plug). Many factors can contribute to the failure of the plug including, without limitation, cement physical and rheological properties, displacement fluid rheological properties, plug mechanical and physical properties, length of the horizontal well, drilling mud properties, the use of a bottom plug, and casing mechanical properties.

Attempts to mitigate cement plug failure involve the use of multiple plugs having multiple fins, leading to trends in the industry for longer plug lengths and requiring the use of extended length cement launching subs (or cement launching head). Use of such plugs can be limited, however, where cement head design restricts the total length of the plug or plugs that can be launched from surface. Such plugs are also typically a one-size-fits all for variable casing string weights and, as a result, unpredictable contact pressure (i.e., squeeze against the ID of the string) can arise, particularly in heavier casing. Such excessive contact pressure necessarily results in increased sliding friction, heat, and an increase in the pressure differential across the plug, causing excess wear and tear. Uneven contact pressure can also cause uneven contact surface area, e.g., circumferential wrinkles along the fins and the ID of the casing string, often resulting in uneven fin wear and damage where sections of the fins are torn away.

Other attempts to mitigate cement plug failure involve the use of a viscous fluid or gel 'spacer' placed between cement and the cement plug, the viscous fluid creating an intermediate barrier between the cement and plug (i.e., between the top of the cement slurry and the downhole nose end of the cement plug pumped downhole to push the slurry through the casing string). Further, where a wet shoe is desired, additional viscous fluid or a displacement fluid can also be placed between the cement and the plug to reduce the likelihood of the cement circulating back uphole above the plug.

Unfortunately, cement stringers continue to be a problem in the oil and gas industry. Many cement plugs used in current cementing operations were designed for use when wellbores were predominantly vertical. The lowest portion of such wells, referred to as the "cellar", was predominantly vertical and, as such, resulted in cement naturally traveling downhole without creating cement stringers. For this reason, cement plugs commonly used in the industry are manufactured from rubber and made using standard molds. Such plugs, however, are not designed to withstand cement (i.e., abrasive solids) that have settled in the horizonal portion of the wellbore due to gravity. Moreover, traditional rubber plugs are often ill equipped to address fluid stratification (low to high density in the horizontal portion of the wellbore) and/or dehydration of the cement slurry as liquid leaks past the plug. In some cases, air at standard temperature and pressure can become trapped between fins, with higher pressures leading to higher contract pressures and higher wear rates.

New cement plug design and construction is time consuming and there remains a long felt need for improved, optimized cement plugs technologies that can be used in horizontal wells.

There remains a need for an improved cement plug for use in cementing operations in the oil and gas industry, such plugs designed to maintain sufficient and consistent contact pressure with the ID of the casing string as it travels downhole.

SUMMARY

According to embodiments, an apparatus and methods of use for releasably providing at least one cement plug into a casing string positioned within a subterranean wellbore are provided, the at least one cement plug for wiping the inner surface of a casing string. In some embodiments, the apparatus may comprise at least one housing tubular forming a longitudinal housing bore, the housing tubular operably engaged with the casing string and forming at least one annular stop within the longitudinal bore for releasably retaining the at least one cement plug. In some embodiments, the at least one cement plug may comprise at least one tubular plug body forming a longitudinal plug bore extending therethrough, the tubular body having at least one wiper fin mounted about and extending radially outwardly therefrom. The at least one tubular plug body may further comprise at least one retainer ring, the retainer ring forming an anchoring mechanism about its outer surface for corresponding with the annular stop of the housing tubular to releasably anchor the at least one cement plug to the at least one housing tubular within the casing string.

In some embodiments, the at least one cement plug may further comprise at least one disc valve sealingly positioned within the longitudinal bore. In some embodiments, the disc valve may comprise a dissolvable or burstable valve for temporarily extending substantially across, and preventing fluid flow through, the longitudinal bore.

In some embodiments, the at least one wiper fin may comprise at least one expansion member configured for biasing the at least one wiper fin radially outwardly and into sealing engagement with the inner surface of the casing string. In some embodiments, the at least one expansion member may form at least one projection for biasing the at least one wiper fin radially outwardly.

In some embodiments, the at least one housing tubular may be operably engaged into and run in hole with the casing string.

In some embodiments, the at least one plug may further comprise one or more fluid nozzles. In some embodiments, the at least one cement plug may further comprise at least one check valve sealingly positioned within the longitudinal plug bore. In some embodiments, the at least one plug body forms at least one fluid port for venting fluid from the longitudinal plug bore.

In some embodiments, the at least one cement plug may further comprise at least one nose portion forming an annular latch ring configured for landing in and latching with downhole equipment. In some embodiments, the anchoring mechanism may comprise at least one controllably triggered shear mechanism.

According to embodiments, methods of delivering at least one cement plug into a casing string positioned within a subterranean wellbore are provided. In some embodiments, the methods may comprise providing a plug launch housing forming at least one stop for releasably retaining at least one cement plug, providing at least one cement plug forming at least one anchoring mechanism for corresponding with the at least one stop, positioning the at least one plug into the plug launch housing, launching the at least one cement plug into the casing string, and controllably triggering the anchoring mechanism to release the at least one cement plug within the casing string.

In some embodiments, the plug launch housing may be retrievably provided at surface. In some embodiments, the plug launch housing may be operably engaged in, and run in hole with, the casing string for positioning the at least one cement plugs at one or more predetermined, target locations along the casing string.

In some embodiments, the at least one cement plug may be released from the housing plug launch housing alone or in series. In some embodiments, the method may further comprise controllably triggering the release of the at least one cement plug from the one or more predetermined locations along the casing string.

In some embodiments, the plug launch housing may be provided in a casing buoyancy system.

In some embodiments, the method may further comprise rupturing at least one disc valve positioned within the at least one cement plug to reinstate fluid flow through the casing string. In some embodiments, the rupturing of the at least one disc valve may occur before or after the release of the one or more cement plugs from the predetermined location in the casing string.

In some embodiments, the method may further comprise providing the at least one plug before, during, or after casing or cementing operations.

BRIEF DESCRIPTION OF THE DRAWINGS

Various objects, features, and advantages of the present technology will be apparent from the following description of particular embodiments thereof, as illustrated in the accompanying drawings. The drawings are not necessarily to scale, emphasis instead being placed upon illustrating the principles of various embodiments of the technology. Similar reference numerals indicate similar components.

FIG. 8A), and without any obstruction within central bore (e.g., providing a hollow cement plug; FIG. 8B), according to embodiments;

FIG. 12A), and shown released from position and without any obstruction within central bore (e.g., providing a hollow cement plug; FIG. 12B), according to embodiments;

DETAILED DESCRIPTION OF THE PREFERRED EMBODIMENTS

Figure 1A:
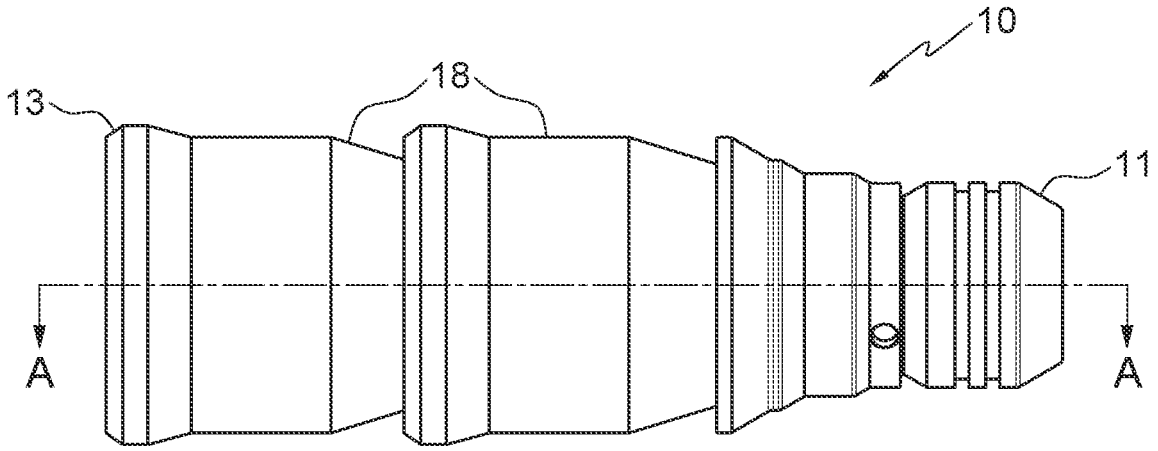
FIG. 1A is a side view of a cement plug, according to embodiments.

According to embodiments, the present apparatus and methods of use provide at least one new, fresh cement plug for use before, during, or after cementing operations, enhancing both contact pressure and surface area between the plug(s) and the inner surface of the casing string and minimizing cement stringers. In some embodiments, the presently improved apparatus and methods of use may provide a modified, retrievable mechanism (housing) for launching the at least one cement plug(s), alone or in series, from surface before during or after casing and/or cementing operations. In other embodiments, the presently improved apparatus and methods of use may provide a modified mechanism (housing) run in hole with conventional casing string during casing operations for launching the at least one cement plug(s) alone or in series near or into the lateral section of a wellbore before, during, or after casing operation. In yet other embodiments, the presently improved apparatus and methods of use may provide a modified system for providing at least one cement displacement plug within a casing buoyancy sub, advantageously providing the CDP at any predetermined, target location within the wellbore.

According to embodiments, the present apparatus and methods of use provide an improved cement plug designed for optimal contact pressure with the internal diameter 'ID' of a casing string. In some embodiments, the presently improved cement plug may be optionally varied in length, in contact pressure, and in contact area, ensuring sufficient wiping of the string ID, regardless of the casing string weight and without requiring any extended plug launching sub.

In some embodiments, the presently improved cement plug and methods of use advantageously ensure that the contact pressure between the cement plug and the casing string ID be continuously maintained during use, preventing excessive contact pressures therebetween, and preventing excessive drag thereby eliminating excessive pressure differentials across the plug. The presently improved cement plug and methods of use also advantageously ensure that the contact pressure between the cement plug and the casing string ID be uniformly maintained around the circumference of the plug during use, preventing folding and/or wrinkling of the fins.

It is an object of the present embodiments to provide at least one fresh, new cement plug pre-loaded within a plug housing, the housing being retrievably provided at surface (i.e., removed from surface for reuse after cementing operations), or operably connected to the casing string as it is run downhole. In some embodiments, plug housing may be configured to controllably retain or 'anchor' at least one plug in place until its release is triggered and the plug is pumped downhole (serving as a fresh plug to wipe excess cement from the horizontal or deviated portion of the wellbore). In such embodiments, the at least one plug(s) may be housed within the plug launch housing at surface and launched into the casing string as desired. In this manner, a first 'top' plug may be launched into the casing string followed by any number of subsequent plugs operable to engage the first plug and combine therewith to form a longer 'top' plug.

It is also an object of the present embodiments to provide the at least one plug(s) at predetermined, target locations along the casing string. In such embodiments, the at least one plug launch housing strategically positioned for running in hole with the casing and cemented in place (i.e., during casing operations). Then, when desired, the at least one plug(s) may be triggered for release from the housing either before or during cementing operations (i.e., before the cementing to clear debris from the wellbore, or after the cement slurry has been pumped downhole to wipe the inner surface of the casing string) and pumped downhole until landing at the toe of the wellbore.

Advantageously, it is yet a further object to configure the at least one plug launch housing to be positioned within a casing buoyancy system and run inhole during casing operations, providing a new, fresh cement plug that may be controllably released from the heel of the wellbore. For example, the present apparatus and methods of use may be configured to provide at least one fresh, new cement plug pre-loaded within a casing buoyancy system ("CBS", as described in U.S. patent application Ser. No. 17/717,435, incorporated entirely herein by reference), such CBS being configured to float the casing string to be cemented as it is run in hole. In such embodiments, the CBS may be configured to controllably retain at least one plug in place until its release is triggered and the plug is pumped downhole (serving as a fresh plug to wipe excess cement from the horizontal or deviated portion of the wellbore). In such embodiments, the at least one plug(s) are positioned within the CBS as it initially serves to trap air in a sealed-off lower portion of the casing string to 'float' the string as it is run in hole (i.e., during casing operations). Then, when desired, the at last one plug(s) may be triggered for release from the CBS either before or during cementing operations (i.e., before the cementing to clear debris from the wellbore, or during cementing when the cement slurry has been pumped downhole to wipe the inner surface of the casing string) and pumped downhole until landing at the toe of the wellbore.

It is yet a further object of the present embodiments to provide at least one fresh, new cement plug enabling enhanced contact pressure and surface area between the plug(s) and the inner surface of the casing string while using standard cement head designs, i.e., without requiring customized cement head configurations.

Herein, the following terms are used for explanatory purposes and are not intended to limit or alter the actual componentry or implementation of the present apparatus and methods of use. The terms "above/below" and "upper/lower" are used for ease of understanding and are generally intended to mean the relative uphole and downhole from surface. The term "uphole" is intended to mean along the drill string or the wellbore from the distal end towards the surface and the term "downhole" is intended to mean along the drill string or wellbore from the surface towards the distal end.

Herein, the term "upstream" is intended to mean along a flow path towards the source of flow, and the term "downstream" is intended to mean along a flow path away from the source of the flow.

One primary function of a cement plug used during cementing operations in the oil and gas industry is to serve as a mechanical barrier to keep fluids separated during the operations, and to wipe residual mud film and other materials from the inside surface of the casing ID. Without being limited to theory, it is contemplated that separation and wiping efficiency may be directly related to plug wear resistance and the balancing design process to achieve optimal fin stiffness and fluid containment. For instance, it is contemplated that separation and wiping efficiency may be directly related to plug parameters such as fin shape, length, thickness, angles, etc., which may be optimized to maintain complete and continuous contact pressure between the plug and the casing string.

The presently improved cement plug(s) will now be discussed having regard to FIGS. 1-14.

Figure 1B:
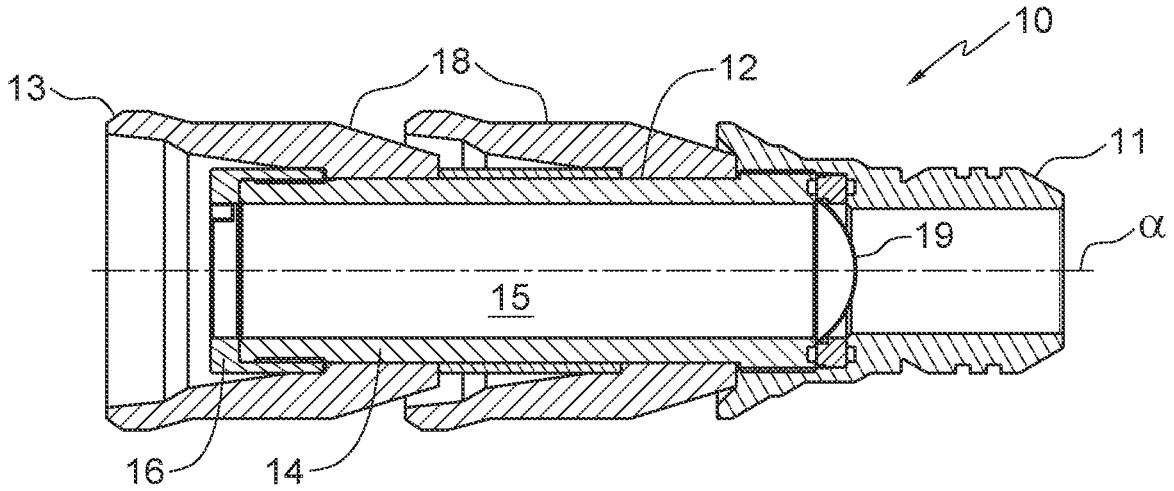
FIG. 1B is a side cross-section view of the cement plug shown in FIG. 1A (along lines A-A), according to embodiments.

According to embodiments, having regard to FIGS. 1A and 1B, an apparatus comprising at least one improved cement plug 10 is provided. Improved cement plug 10 may comprise a substantially cylindrical tubular body 12 (FIG. 1B) having a first downhole or 'nose' end 11 and a second uphole or 'heel' end 13. Plug 10 may form a longitudinal bore 15 extending therethrough, bore 15 having a central longitudinal axis $\alpha$.

In some embodiments, the at least one plug 10 may be designed to be launched or deployed downhole into a casing string (not shown) before, during, or after casing operations with the downhole nose end 11 leading relative to a downhole direction of movement of plug 10 through the casing.

In some embodiments, the at least one plug 10 may be launched from surface and driven downhole either mechanically or hydraulically, or via any other appropriate means known in the art. At least one annular seal may be provided about the nose 11 of the plug 10 for sealingly engaging plug 10 and effectively isolating the wellbore therebelow. It should be appreciated that although one plug 10 is described herein for explanatory purposes, one or more plugs 10 may be launched into the wellbore (e.g., such plugs 10 being launched alone and/or in series).

In some embodiments, plug body 12 may comprise a single tubular, while in other embodiments, plug body 12 may comprise at least two tubulars 14, 16, n operably connected end to end. Uphole tubular 14 may be configured for threadable connection with downhole tubular 16 (e.g., box and pin joint, or the like).

In some embodiments, plug body 12 may be manufactured from solid materials suitable for use in a downhole environment, including aluminum or steel. Plug body 12 may be manufactured to have a phenolic core, or other such core, designed to be drilled out with a PDC drill bit, or the like. In other embodiments, optionally and as desired, plug body 12 may be manufactured with one or more temporary, dissolvable portions and/or bursting portions (e.g., rupture discs/membranes) sealingly positioned, and effectively plugging fluid flow through, longitudinal bore 15. For example, plug(s) 10 may contain one or more rupture or burst discs 19 (see FIG. 2B) positioned within longitudinal bore 15.

In some embodiments, burst disc 19 may be positioned at or near joint between tubulars 14, 16. Disc 19 may be controllably ruptured by application of a sufficient fluid pressure differential across disc 19 (e.g., a sufficient fluid pressure differential between fluid within central bore 15 downhole of disc 19 and fluid within central bore 15 uphole of disc 19). Before disc 19 is ruptured, fluids within central bore 15 are prevented from flowing axially through plug body 12. Once disc 19 is controllably ruptured, fluids may flow through central bore 15 and downhole out nose 11 of plug body 12. It should be appreciated that rupturing disc 19 may serve to controllably reinstate fluid flow through the casing string.

In some embodiments, plug 10 may comprise at least one flexible annular wiper fin(s) 18 mounted about rigid plug body 12. It should be appreciated that although one fin 18 is described for explanatory purposes, plug 10 may comprise one or more fins 18 (e.g., such fins 18 being longitudinally spaced in series about tubular body 12). As the at least one plug 10 is pumped downhole through the casing string, the at least one wiper fin 18 makes contact with and wipes the surrounding inner surface of the casing string.

Figure 2A:
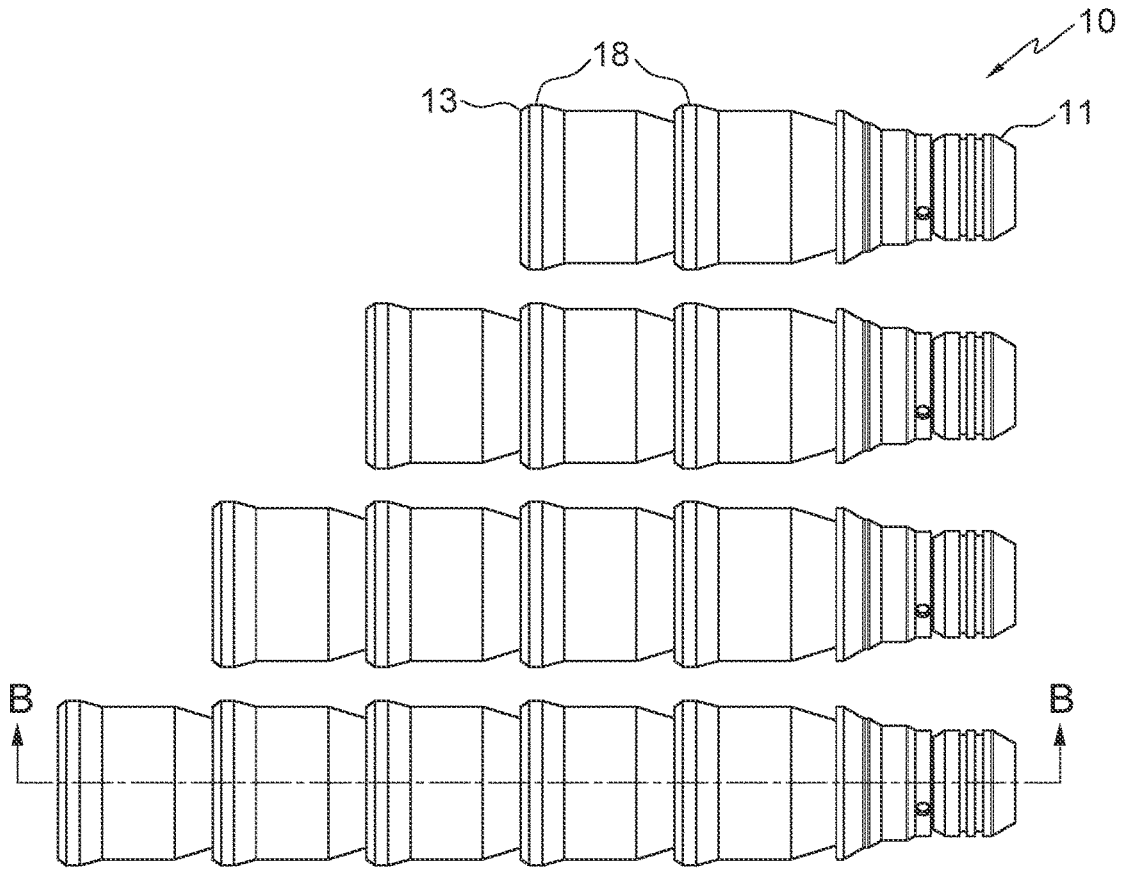
FIG. 2A shows side views of an alternative embodiment of the cement plug shown in FIG. 1A, the plug shown having differing lengths (such lengths being optional), according to embodiments.
Figure 2B:
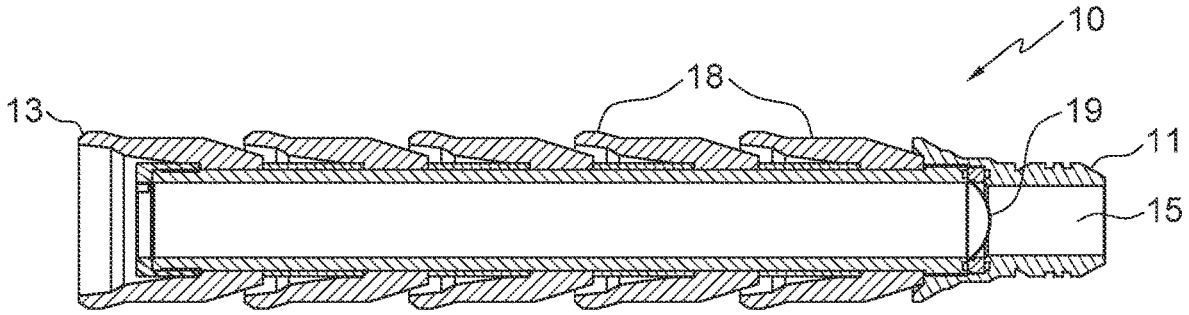
FIG. 2B shows a side cross-section view of one of the alternative cement plugs shown in FIG. 2A (along lines B-B)

According to embodiments, having regard to FIGS. 2A and 2B, the length of plug 10 may be optionally increased by incorporating a plurality of tubulars and corresponding fin(s) 18 operably connected end to end. Without being limited to theory, plug 10 may be configured such that, where the first, downhole fin 18 may wear, one or more backup fin(s) 18 positioned uphole therefrom may serve to maintain contact pressure and surface area with the inner surface of the casing string.

In some embodiments, the at least one wiper fin(s) 18 may be manufactured from any resilient material or composite materials operative to contact with and wipe the inside surface of the casing string, including hydrogenated nitrile butadiene rubber (HNBR, e.g., hyperplastic nitrile 70 durometer). In some embodiments, fin 18 may be sized and shaped to optimize contact pressure (i.e., the pressure between each at least one fin 18 and the inside surface of the casing string) and contact area (i.e., the surface area between each at least one fin 18 and the inside surface of the casing string).

Herein, contact pressure may be a pressure sufficient to at least ensure an adequate grip between the fin 18 and the inner surface of the casing string, enabling thorough wiping thereof. Contact area may be a substantially continuous engagement area between the fin 18 and the inner surface of the casing string (e.g., fin 18 contact about the circumference of the inner surface), enabling consistent wiping thereof.

Advantageously, the at least one plug 10 may be optimally designed for use in casing strings of varying sizes/weights. For example, it has been determined that simply increasing the size and/or shape (i.e., thickness, durability, and outer diameter) of fin 18 is not always optimal. In some cases, known cement plugs having outer diameters that are too large for 4.5 in casing string still suffer from insufficient fin thickness to achieve adequate contact pressure for 5.5 in casing string. Moreover, known cement plugs are typically manufactured for one size of casing, such casing having different weights (i.e., known CDPs are made for use in one size of casing having all casing weights, such as 4.5 in casing where the ID can fluctuate from 3.826" to 4.000", corresponding to 11.6 lb/ft to 15.1 lb/ft). As described, the presently improved plug 10 may comprise at least one fin 18 configured for optimal contact pressure and area in casing strings of varying size and weight.

According to embodiments, optionally, the presently improved plug 10 may be configured to comprise at least one expansion member contained within plug 10 for achieving and maintaining enhanced contact pressure and contact area between fin 18 and the inner surface of the casing string (i.e., the inner diameter of the casing string), enhancing wiping of the inner surface during cementing operations. In this manner, both contact pressure and contact area of fin 18 may be continuously maintained, enabling weight-specific, enhanced plug 10 performance even where fins might break down, deform, or suffer from insufficient material stiffness.

In some embodiments, having regard to FIGS. 3A-3F, fin 18 may be manufactured to contain at least one expansion member 20 for controllably expanding or biasing fin 18 radially outwardly, i.e., for achieving and maintaining contact pressure and contact area of fin 18 in outward engagement with the inner surface of the casing string as the plug 10 passes therethrough.

Figure 3A:
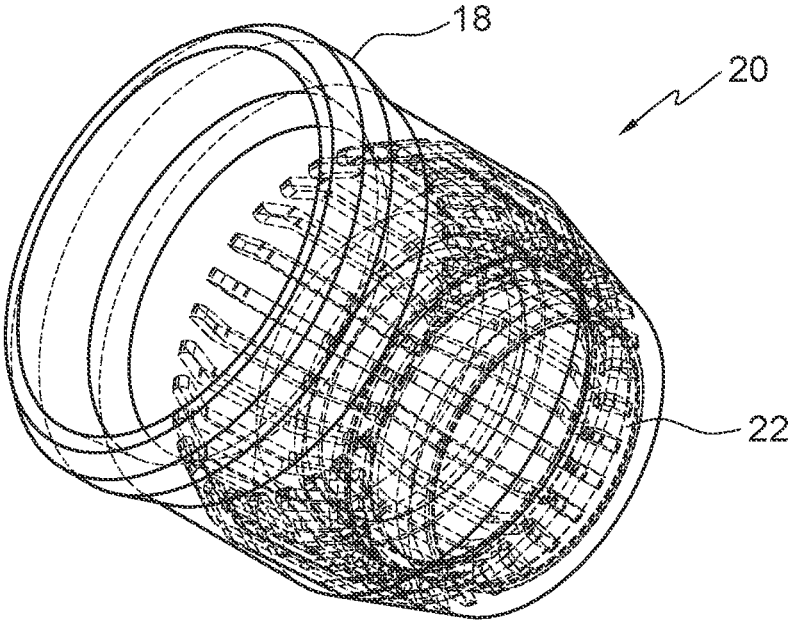
FIGS. 3A-3F show an expansion member for integration into embodiments of the cement plugs shown in FIG. 1A and/or FIG. 2A, the expansion member shown in a perspective view integrated into at least one fin (FIG. 3A); in perspective views in isolation (FIGS. 3B and 3C); in a side view (FIG. 3D); in cross section side view (FIG. 3E, taken along lines C-C of 3D); and in a further cross section side view (FIG. 3F), according to embodiments.
Figure 3B:
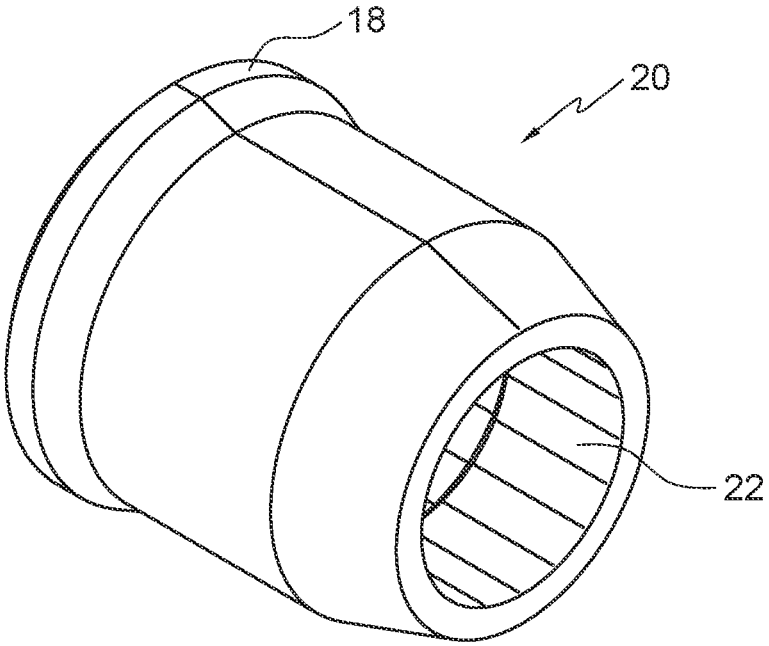
Figure 3C:
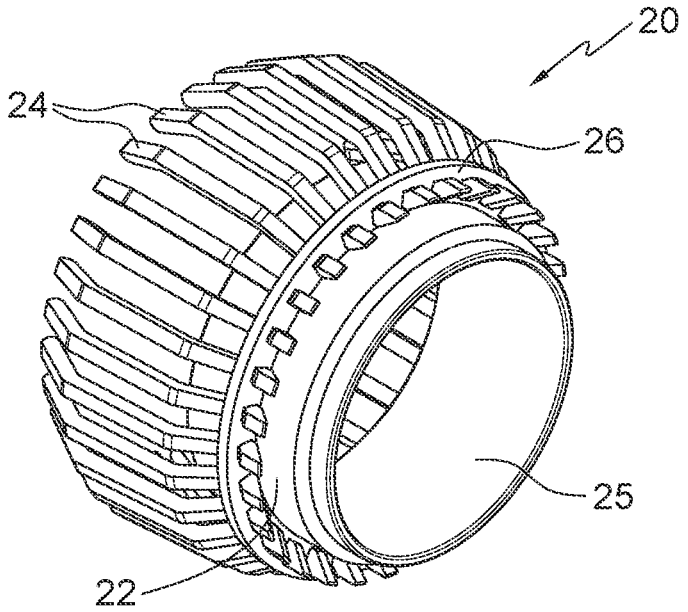
Figure 3D:
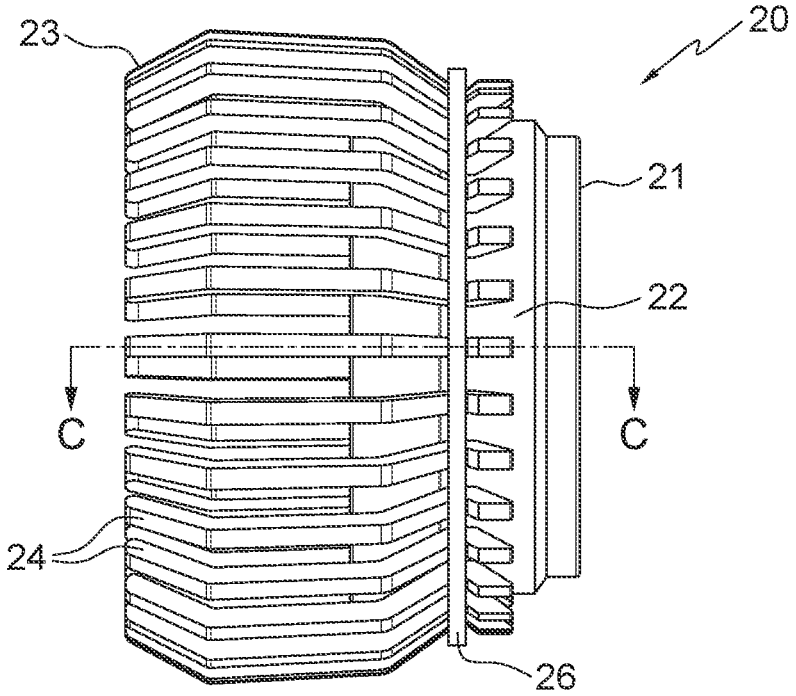
Figure 3E:
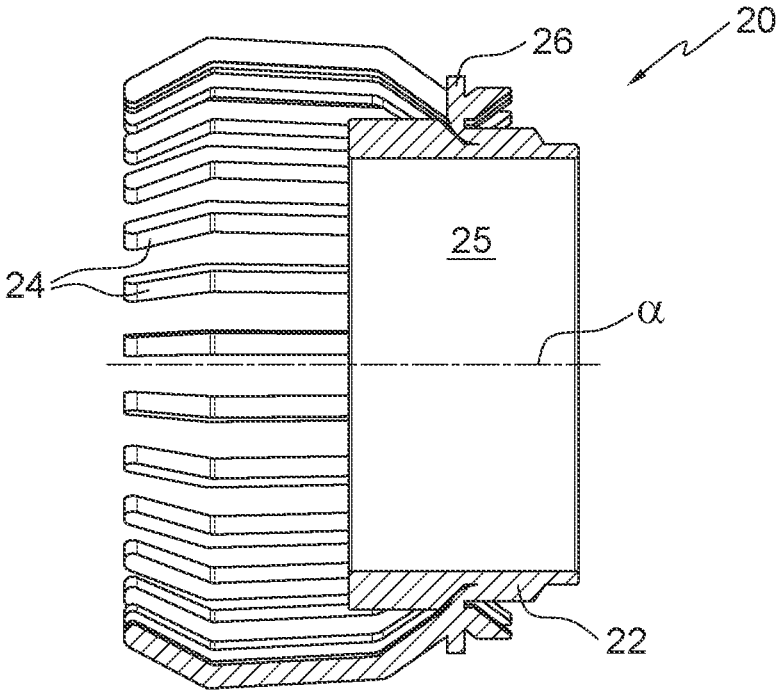
Figure 3F:
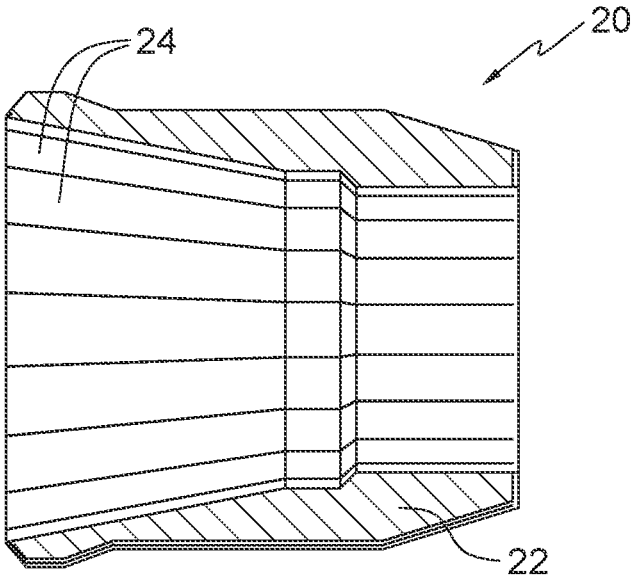

In some embodiments, expansion member 20 may comprise a substantially cylindrical tubular body 22 having a first downhole or 'nose' end 21 and a second uphole end 23 (see FIG. 3D). Expansion member body 22 may form a longitudinal bore 25 extending therethrough, bore 25 having a central longitudinal axis corresponding with and parallel to axis $\alpha$ of plug 10 (see FIG. 3E), establishing a fluid path through member bore 25 and plug bore 15.

In some embodiments, expansion member 20 may form a plurality of biasing fingers or projections 24 extending longitudinally from tubular 22. Projections 24 may be anchored in tension for outward expansion (e.g., cantilevered) by at least one retainer ring 26, ring 26 permitting outward movement of projections 24 but preventing inward movement thereof.

In some embodiments, projections 24 may be manufactured from substantially rigid material, such material being integrated or incorporated into resilient fin 18. In this manner, as will be described, when pressure-activated by a pressure differential between fluid pressures inside bores 15, 25 and fluid pressures outside of plug 10 projections 24 serve to shift fin 18 outwardly until sufficient contact pressure and area between the fin 18 and the inner surface of the casing string is achieved. Expansion member 20 thus optimizes the contact pressure (squeeze) and contact area (wiping characteristics) achieved by the plug 10.

According to embodiments, the presently improved apparatus and methods of use may be configured to mitigate contamination of the fins 18 by solids within the casing string and other debris within the harsh wellbore environment, and to prevent the formation of cement stringers. In some embodiments, advantageously, the at least one plug 10 may be configured to withstand cement (i.e., abrasive solids) that have settled in the horizonal portion of the wellbore due to gravity. In some embodiments, the at least one plug 10 may be configured to forcibly, controllably evacuate air trapped between fins 18, such air causing higher contact pressures and wear rates.

Figure 4:
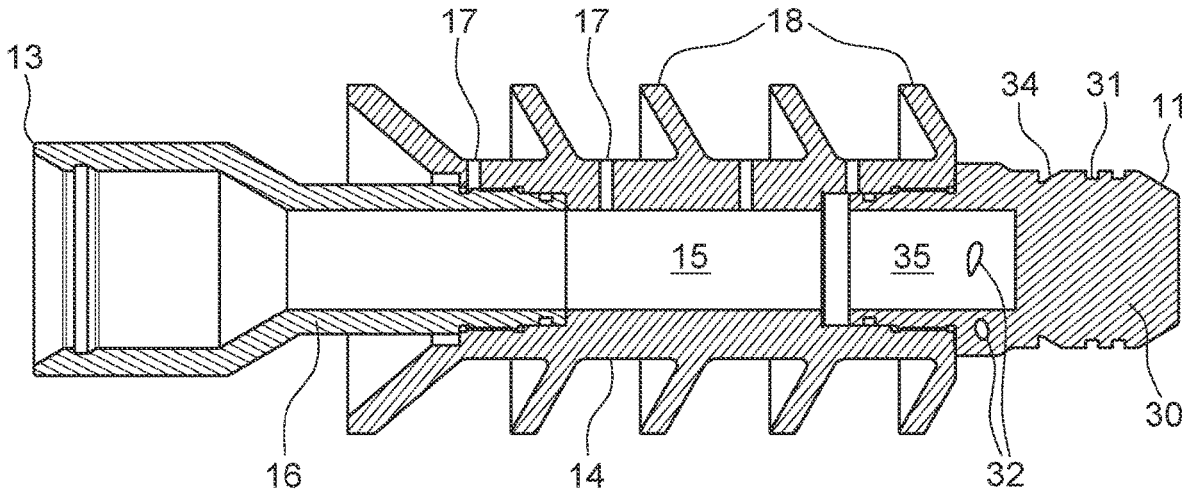
FIG. 4 shows a side cross-section view of a further alternative embodiment of the cement plug shown in FIG. 1A, the alternative plug embodiment having a modified nose (downhole end) comprising at least one fluid nozzle, according to embodiments.
Figure 5A:
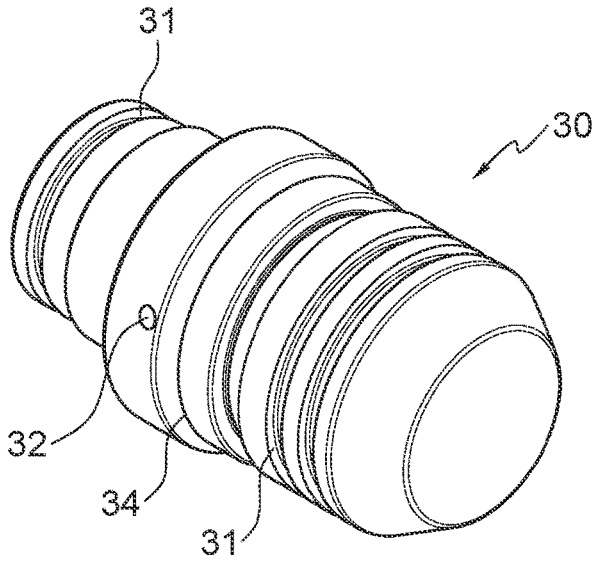
FIGS. 5A-5E show various views of the modified nose end of the alternative cement plug shown in FIG. 4, the nose end shown in isolation in a perspective side view (FIG. 5A), a side view (FIG. 5B), a cross section front view (looking uphole) showing fluid nozzles (FIG. 5C, taken along lines D-D in FIG. 5B), a cross section front view (looking uphole) showing the nose slidably positioned within plug body (FIG. 5D), and a cross section side view showing fluid nozzles (FIG. 5E, taken along lines E-E of FIG. 5D), according to embodiments.
Figure 5B:
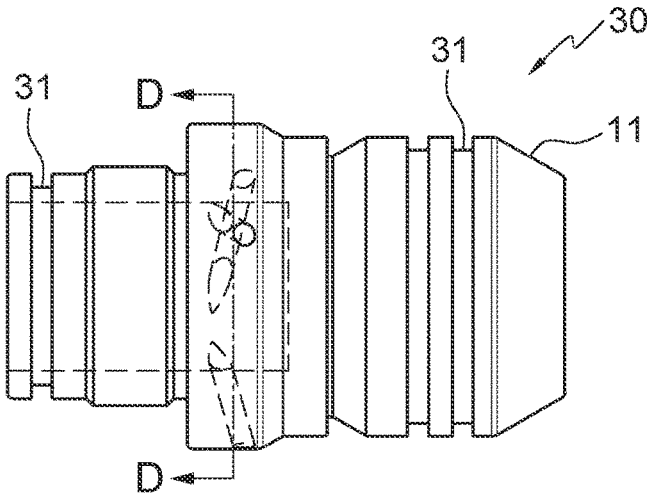
Figure 5C:
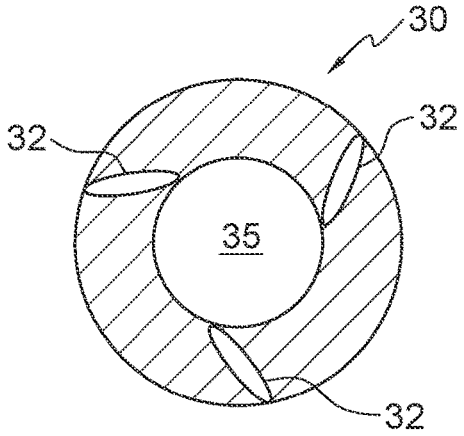
Figure 5D:
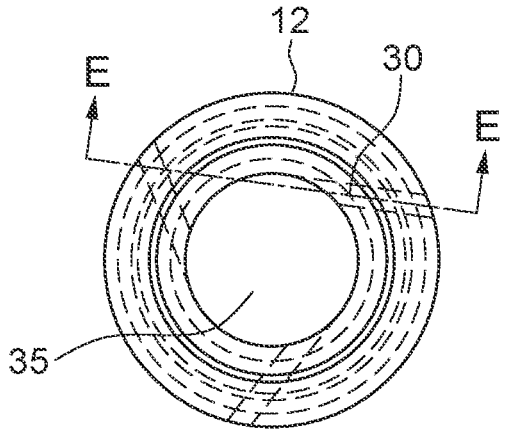
Figure 5E:
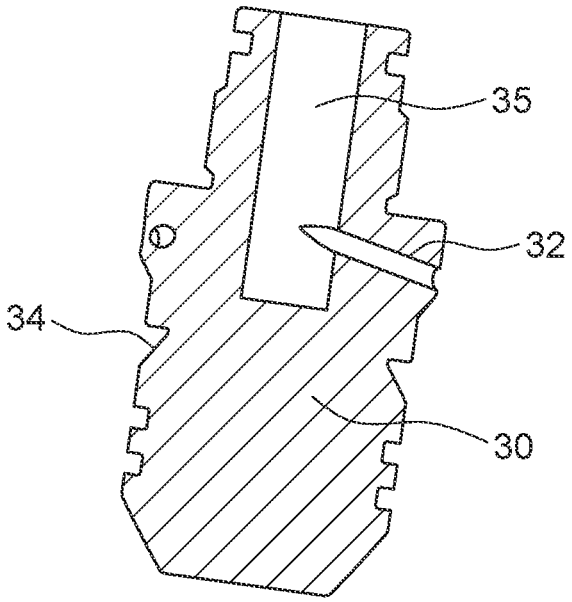

According to embodiments, as above and having regard to FIG. 4, an alternative embodiment of the cement plug 10 may comprise plug body 12 consisting of at least two tubulars 14, 16, n operably connected via, for example, threaded engagement, or the like. In some embodiments, at least one body tubular 14, 16 may form at least one fluid port 17 permitting fluid flow (i.e., fluid 'venting') from central plug bore 15 to the annular space between plug 10 and the casing string. Ports 17 may be operative as vent holes to equalize pressure, as might be required for air trapped between fins 18 (e.g., where air might be trapped between multiple dynamic seals/fins positioned in series) during installation of the at least one plug 10. Ports 17 thus prevent trapped air from causing excessive pressure differential (drop) across the fins 18 as plug 10 travels deeper into the casing string, alleviating excessive contact pressure and excessive wear on the fins 18. In some embodiments, plug 10 may further comprise a modified nose portion 30, as further described having regard to FIG. 5A-5E.

In some embodiments, having regard to FIGS. 5A-5E, plug 10 may optionally comprised a modified nose portion 30, the nose 30 configured to form at least one fluid nozzle 32 permitting fluid flow from central bore 35 to the annular space of the casing string, resulting in a cement displacement plug 10 ("CDP") operable to provide a controllable fluid flow rate therethrough. Nose 30 may form at least one annular seal groove 31 (FIG. 5B) for receiving at least one annular seal (not shown).

In some embodiments, nozzles 32 may comprise tangential jets, or other fluid distribution mechanisms known in the art, at or near the nose end 11 of plug 10, creating mixing energy to re-entrain solids into fluids flowing through plug bore 15, nose bore 35 and out into the casing string. For example, as the at least one plug 10 pushes the cement slurry through the casing string, nozzles 32 may serve to prevent fine particles in the cement slurry from settling out onto the low side of the horizontal or deviated portion of the casing string. In some embodiments, the tangential nature of the nozzles 32 may create a circumferential fluid flow (e.g., swirling fluid flow) for further assisting in preventing separation or settling of fine particles and for minimizing contact of such particles against fins 18.

In some embodiments, nozzles 32 may also enable the creation of a fluid "spacer", i.e., the introduction of a volume of engineered fluid between downhole nose end 11 of plug 10 and the top of the cement being wiped from the casing string. Fluid spacers provide a barrier between the cement slurry and the fins of the at least one plug 10, minimizing contact of the solids in the slurry and increasing the life space of the plug 10. Fluid spacers also operate to ensure the cement slurry remains sufficiently fluidic (i.e., hydrated). In some embodiments, target fluid spacer volumes may be between a maximum range of 200-300 liters to avoid excessive volume of spacer fluid within the casing string between the nose end 11 of plug 10 and the top of the cement being pumped downhole. Such volumes also ensure proper fluid properties are maintained once the cementing operations are complete and the plug 10 has landed at the toe of the well (i.e., where such fluids may be released in the formation).

As would be appreciated, target fluid spacer volumes may also be controllably determined as a function of the differential pressure across the CDP 10. For example, the fluid pressures required to move a CDP 10 downhole may be relatively low where minimal cement/wellbore debris is present. However, such fluid pressures increase where plug 10 contacts cement/wellbore debris within the casing string, causing a higher pressure differential (drop) across the CDP 10 and through the at least one nozzle 32. In this manner, the increased pressure drop creates a stronger jetting action through nozzles 32 and disperses the cement/debris. Also in this manner, the size and quantity of the at least one nozzle 32, and the pressure drop across the CDP 10, may regulate the flow rate and therefore the optimal volume of fluid spacer.

As would also be appreciated, a fluid spacer may be used to create a wet shoe. Alternatively, a casing volume can be created between a float shoe and float collar positioned downhole, such volume operative to accept the spacer fluid thereby avoiding the creation of a wet shoe. The spacer fluid volume may increase as the cement displacement plug 10 travels to the toe of the well (as compared to pre-installing the spacer at the wellhead before the plug 10 is launched).

In some embodiments, CDP 10 may provide for at least three substantially forward/downhole facing nozzles 32 (e.g., 3/16" diameter) or other such suitable configuration for maximizing mixing energy within spacer final volume fluids. For e.g., providing more nozzles of larger size enables increased fluid flow and thus creates a larger spacer volume (e.g., greater than 300 liters). In this manner, embodiments of CDP 10 may be specifically configured to provide a controlled volume of engineered fluids through central bore 15 of CDP 10, ensuring the at least one fin 18 is kept clean of debris, remains adequately lubricated, while minimizing mixing between the cement and the spacer fluid (via density and viscosity). In some embodiments, for example, a 55-60 cp gel, or other such conventional "flush" fluid, may be pumped downhole ahead of the cement to condition the annulus.

According to embodiments, the presently improved apparatus and methods of use may be configured to address circumstances where the float shoe and/or float collar positioned at the toe of the wellbore might be leaking, leading to U-tubing of cement from the casing annulus back into the casing string. In some embodiments, advantageously, the at least one plug 10 may be configured to incorporate a valve.

Figure 6:
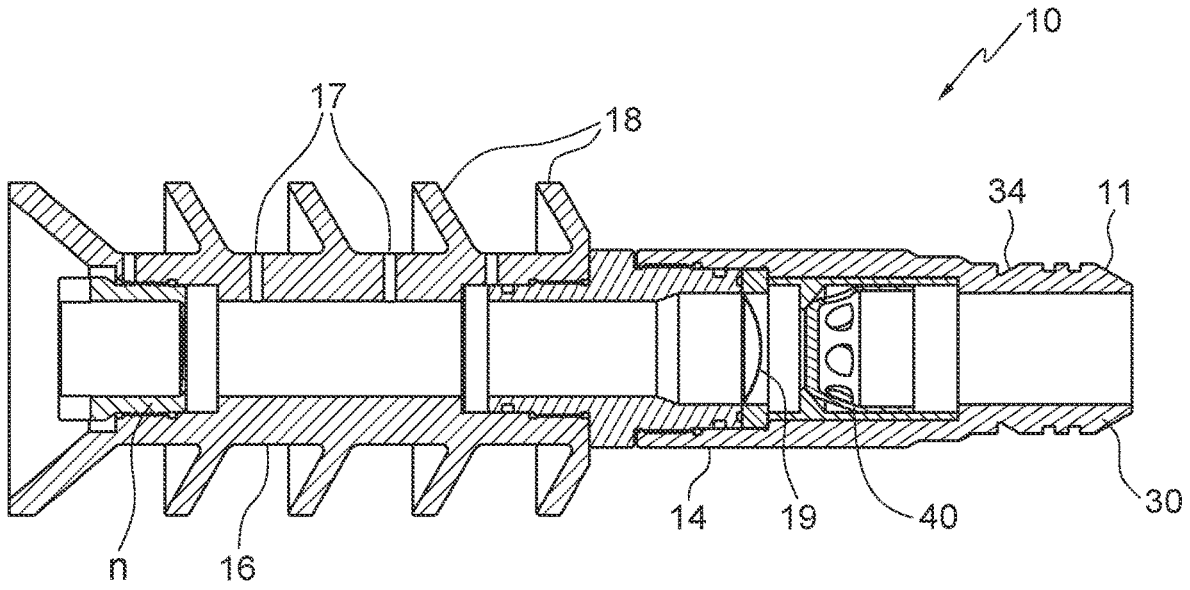
FIG. 6 shows a side cross-section view of yet another alternative embodiment of the cement plug shown in FIG. 1A, the plug shown having a check valve, according to embodiments.

For example, having regard to FIG. 6, the at least one plug 10 may be configured to provide at least one check valve 40, which may be any suitable valve including, without limitation, a hanging style valve, a flapper check valve, or a poppet valve. Valve 40 may be sized and configured to mitigate leakage of cement and other wellbore fluids from re-entering or U-tubing back into central bore 15 of casing string.

According to embodiments, the presently improved plug 10 may be configured to land in and latch to downhole equipment, such as a float collar positioned at the toe of the wellbore. In some embodiments, modified nose portion 30 of plug 10 may be configured to be run inhole with downhole equipment. For example, modified nose portion 30 of plug 10 may form at least one annular latch ring groove 34 about the external surface of nose sidewall, annular ring groove 34 being configured to correspondingly engage and lock with downhole float equipment when desirable to configure plug 10 as a latch-in plug (not shown).

Figure 14:
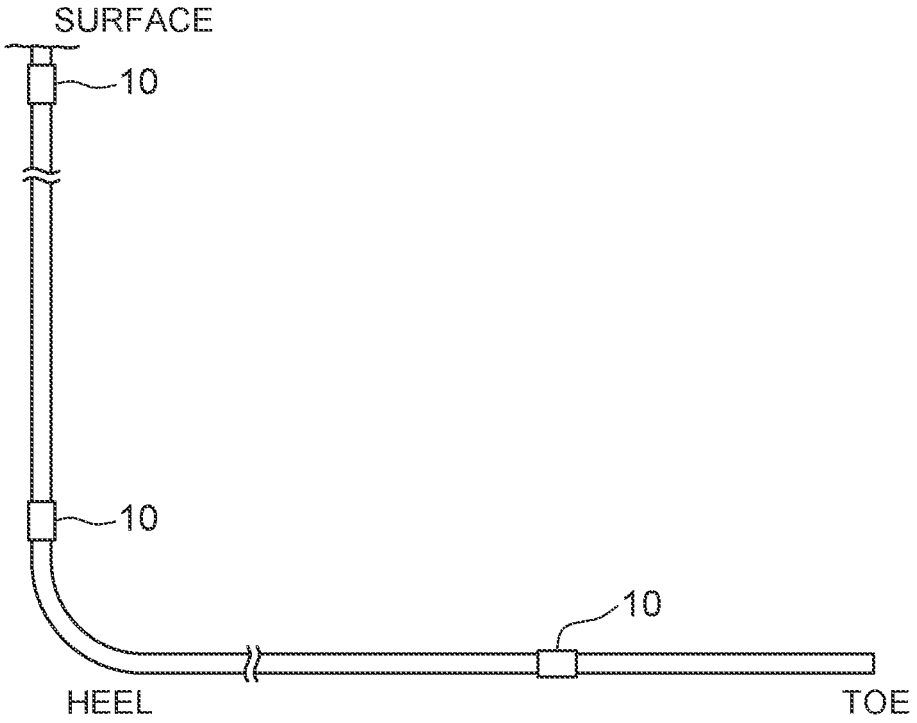
FIG. 14 depicts example positioning of any one of the least one plug lauch housing and/or corresponding at least one cement plugs at various predetermined, target locations of the wellbore, according to embodiments.

According to other embodiments, the presently improved cement plug 10 may be configured to be preloaded into a cement-plug deployment housing or 'sub' operably connected into and run inhole with the casing string during the casing operations. Known cement plug deployment subs can have several lengths but are most commonly long enough to deploy one standard cement plug. Advantageously, the presently improved plugs 10 may be pre-loaded enabling longer or multiple plugs to be launched from surface without the need for an extended length cement launching sub. Moreover, as depicted in FIG. 14, any number of new, fresh cement plugs 10 may be positioned at multiple locations within the wellbore during the casing operations. Moreover, plug launch housing may be configured to be retrieved from surface when operations are complete, providing a versatile, reusable plug launch housing.

For example, in some embodiments, the present apparatus may comprise a plug launch housing configured to controllably retain or 'anchor' at least one plug 10 in place at or near surface until its release is triggered and the plug 10 is pumped downhole (serving as a fresh plug to wipe excess cement from the horizontal or deviated portion of the wellbore). In such embodiments, the at least one plug(s) 10 may be retained within the plug launch housing at surface and launched into the casing string as desired. In this manner, a first 'top' plug may be launched into the casing string followed by any number of subsequent plugs operable to engage the first plug and combine therewith to form a longer 'top' plug.

In other embodiments, the present apparatus may comprise a plug launch housing operably (e.g., threadably) engaged into and run in hole with the casing string and configured to controllably retain or 'anchor' at least one plug 10 at various predetermined, target location. For example, in this manner, it is also contemplated that at least one cement plug 10 may be configured to land, and be releasably anchored, at least past a vertical or 'heel' portion of the wellbore. It is also contemplated that at least one other cement plug 10 may be configured to land, and be releasably anchored, at least partially within a horizontal or 'toe' portion thereof. Each of the foregoing apparatus may be specifically configured to be launched before, during, or after cementing operations, as desired.

Figure 7:
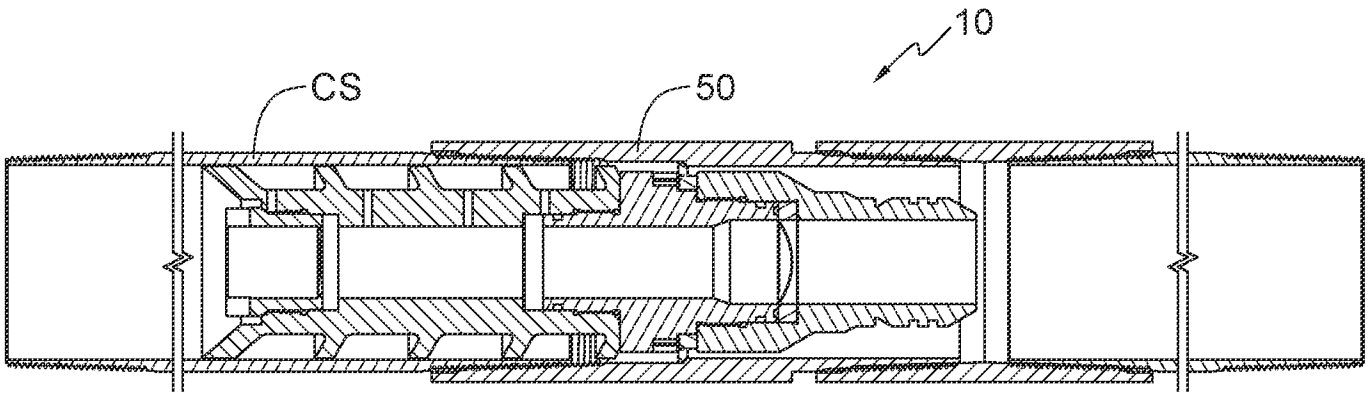
FIG. 7 shows a side cross-section view of yet another alternative embodiment of the cement plug shown in FIG. 1A, the plug releasably retained within a plug housing, according to embodiments.

According to embodiments, having regard to FIG. 7, the presently improved cement plugs 10 may be configured for launch within at least one plug launch housing 50. Housing 50 may comprise at least one tubular operably engaged with and run inhole with the casing string CCS' (e.g., via box and pin joint, or the like) during casing operations. In this manner, any number of the presently improved plugs 10 may be temporarily positioned at surface and/or along the casing string at predetermined target locations (FIG. 14). Advantageously, housing 50 may be configured to provide a temporary, releasable anchoring mechanism such that, when desired, plugs 10 may be controllably released from housing 50 (as described below).

In some embodiments, plug launch housing 50 may configured for corresponding releasable engagement with the at least one plug 10. For example, housing 50 and plug 10 may be configured to provide at least one temporary anchoring mechanism that, when triggered, serves to release plug 10 from housing 50 allowing plug 10 to travel downhole within the casing string (FIGS. 10A-C).

That is, each of the at least one plug 10 may be launched downhole within a housing 50 such that, in a first 'retained' position, plug 10 is temporarily prevented from traveling downhole past housing 50 (i.e., anchoring mechanism anchors plug 10 in place at the location of housing 50 within the casing string). In this position, plug 50 may comprise at least one dissolvable/rupture disc 19 (FIG. 8A), or the at least one dissolvable/rupture disc 19 may already be removed (FIG. 8B). That is, as desired, anchoring mechanism may be set to trigger either before or after dissolvable/rupture disc 19.

For example, depending upon desired operating parameters, plug 10 may be configured such that rupture of the at least one burst disc 19 occurs prior to mechanically triggering/releasing plug 10 downhole (i.e., burst disc 19 may be ruptured or, optionally, nonexistent to form a hollow cement plug embodiment 10). Alternatively, plug 10 may be configured such that rupture of the at least one burst disc 19 occurs after the plug 10 has been triggered for release downhole (i.e., burst disc 19 remains intact). In such embodiments, the at least one burst disc 19 may then be controllably ruptured at the toe of the wellbore, establishing fluid communication with the formation for subsequent oil field operations.

Figure 10A:
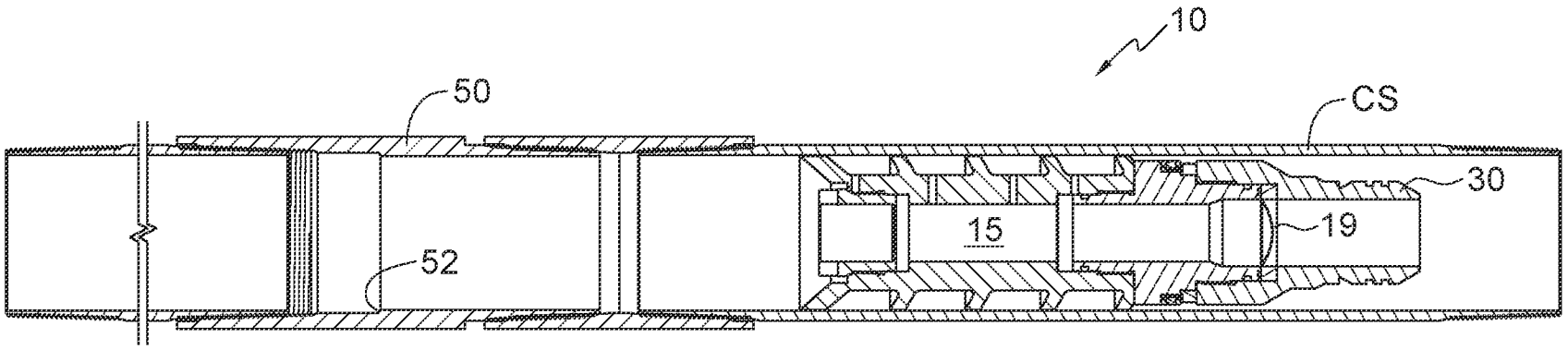
FIG. 10 shows side cross-section views of the alternative embodiment of the cement plug shown in FIG. 7, the plugs shown released from its position within the casing string (FIG. 10A) and having an obstruction within central bore (e.g., a rupture or burst disc.
FIG. 10B), and without any obstruction within central bore (e.g., providing a hollow cement plug.
FIG. 10C), according to embodiments.
Figure 10B:
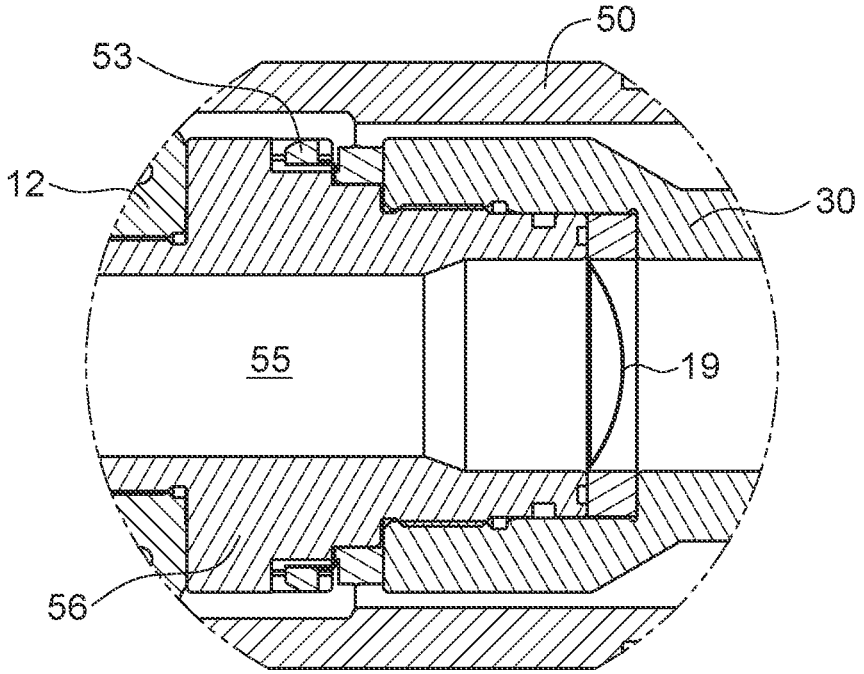
Figure 10C:
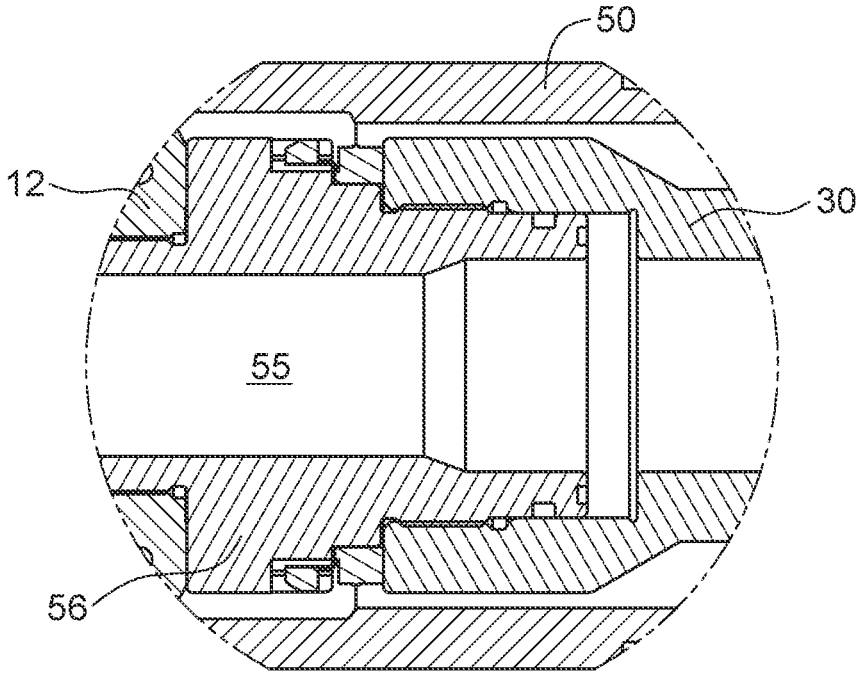

Once controllably triggered, anchoring mechanism serves to release plug 10 from housing 50 to a second 'wiping' position, allowing plug 10 to travel downhole (FIG. 10A). In this manner, cement plug 10 may be temporarily retained within the casing string before, during, or after cementing operations. In this position, plug 50 may comprise at least one dissolvable/rupture disc 19 (FIG. 10A), or the at least one dissolvable/rupture disc 19 may already be removed (FIG. 10B).

Figure 8A:
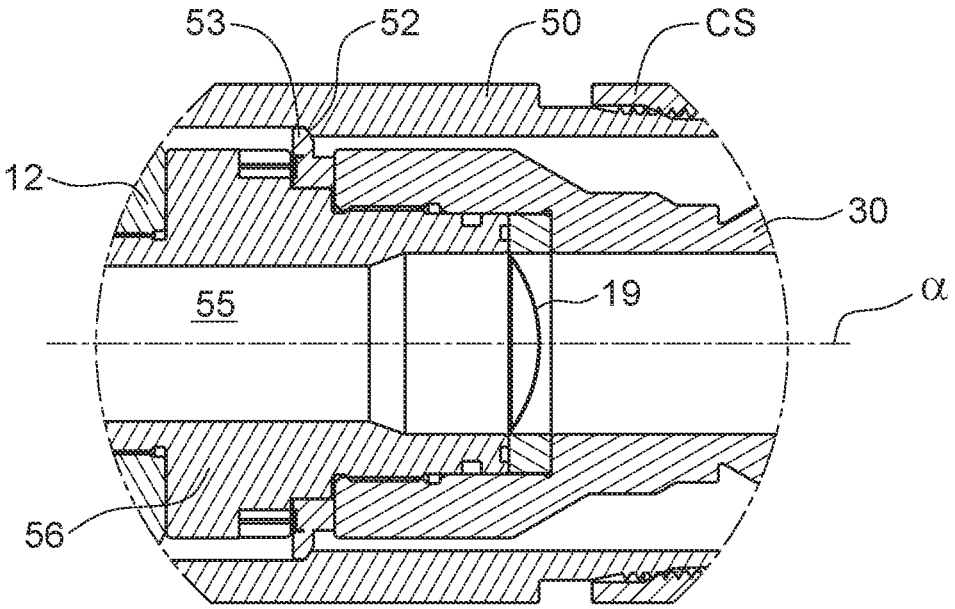
FIGS. 8A-8B show side cross-section views of the alternative embodiment of the cement plug shown in FIG. 7, the plugs shown retained in position within the casing string and having an obstruction within central bore (e.g., a rupture or burst disc.
Figure 8B:
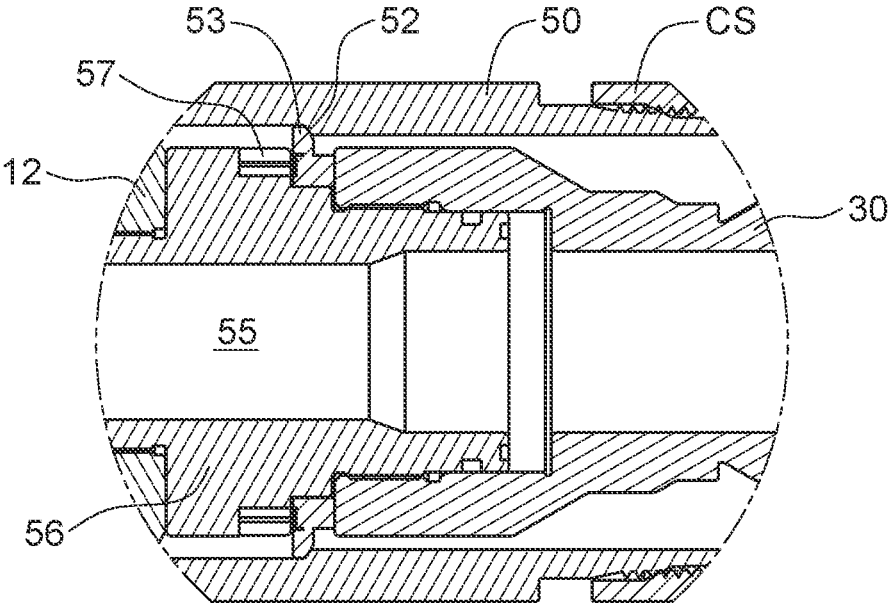

In some embodiments, having specific regard to FIGS. 8A and 8B, housing 50 may form at least one annular shoulder or 'stop' 52 about its inner surface for correspondingly engaging, in abutting relationship, at least one release mechanism (e.g., such as at least one shear pin 53). In some embodiments, shoulder 52 may be formed from the clearance of a standard LTC threaded (e.g., via a tapered box). Although shear pins 53 are described herein, such description is for explanatory purposes only and any release mechanism including, without limitation, any mechanical, hydraulic, electric, magnetic, or the like, or any combination thereof for controllably releasing plug 10 from housing 50 is contemplated.

In such embodiments, the presently improved cement plug 10 may further comprise at least one retainer tubular 56 configured for providing the at least one temporary anchoring mechanism. Retainer tubular 56 may be operably engaged within plug 10 (e.g., via box and pin joint connection), or it may be manufactured to be integral therewith. For example, in some embodiments, retainer tubular 56 may be operably connected end to end within plug body 12 (14, 16) and nose portion 30, as applicable. Retainer tubular 56 may be 'centrally' disposed within plug 10, i.e., retainer tubular 56 may be positioned uphole of nose portion 30 and downhole of at least one tubulars forming plug body 12 (14, 16). Retainer tubular 56 may comprise a substantially tubular body forming a longitudinal bore 55, bore 55 having a central longitudinal axis $\alpha$.

Figure 9A:
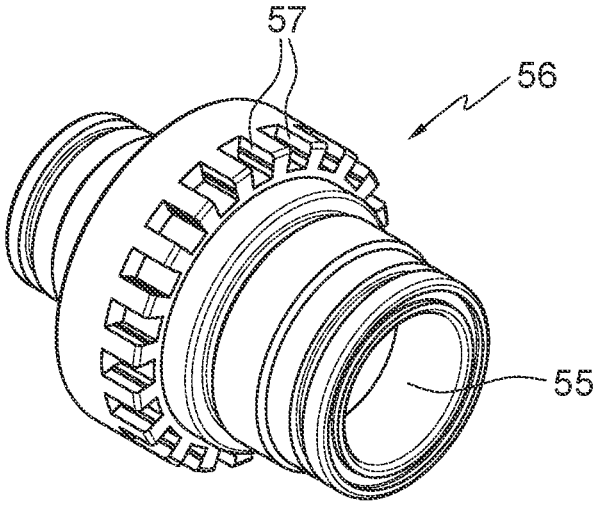
FIGS. 9A and 9B show perspective and side views, respectively, of a retainer tubular configured for retaining the cement plug shown in FIG. 7 within the plug launch housing, according to embodiments.
Figure 9B:
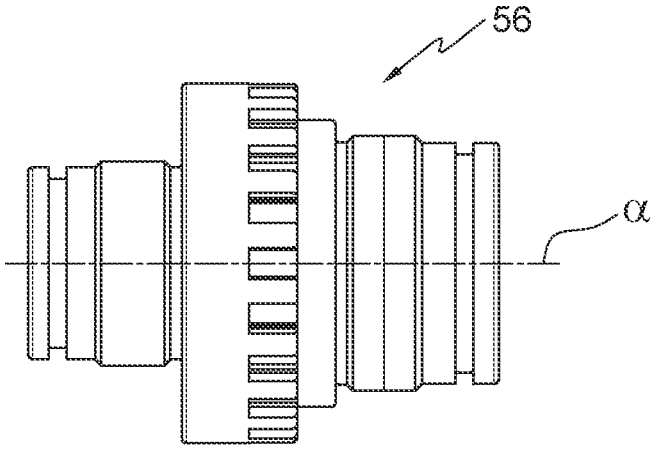

In such embodiments, having regard to FIGS. 9A and 9B, about its outer surface, retainer tubular 56 may form a plurality of longitudinally extending slots, such as pin slots 57 (FIG. 9A), for operably receiving at least one shear pin 53 (shown in FIGS. 8A and 8B). At least one annular seal may be provided about the outer surface of retainer tubular 56 for sealingly engaging retainer tubular 56 within plug body 12.

Figure 11:
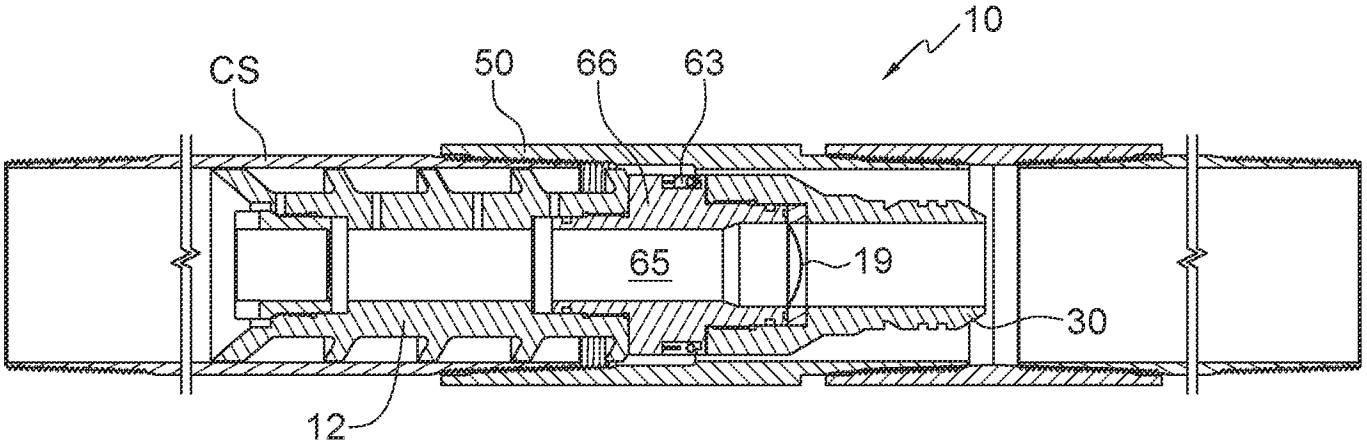
FIG. 11 shows a side cross-section view of yet another alternative embodiment of the cement plug shown in FIG. 1A, the plug releasably retained within a plug housing, according to embodiments.
Figure 12A:
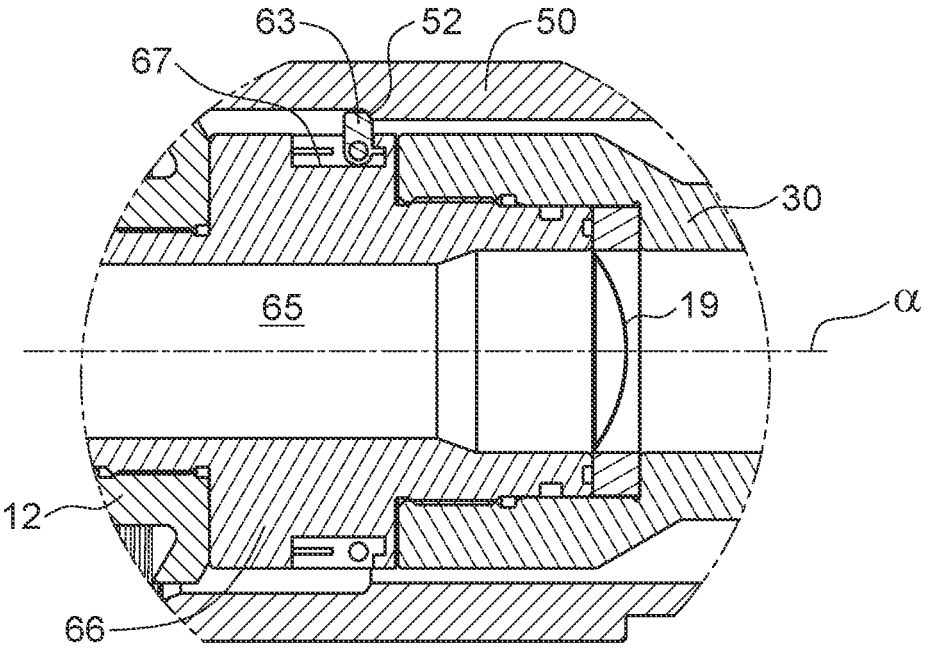
FIGS. 12A-12B show side cross-section views of the alternative embodiment of the cement plug shown in FIG. 11, the plugs shown retained in position within the casing string and having an obstruction within central bore (e.g., a rupture or burst disc.
Figure 12B:
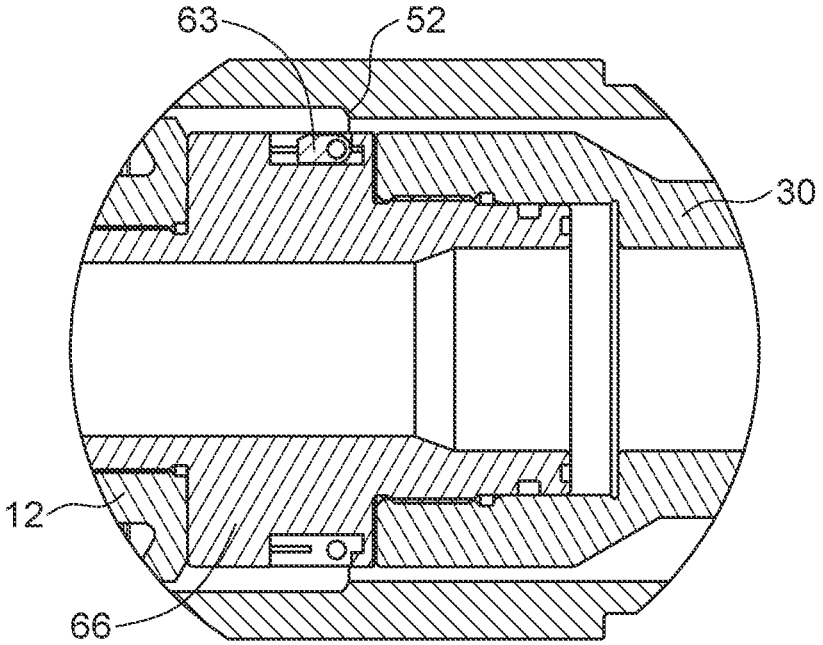

According to alternative embodiments, having specific regard to FIGS. 11, 12A and 12B, housing 50 may form at least one annular shoulder or 'stop' 52 about its inner surface for correspondingly engaging, in abutting relationship, at least one pressure-activated mechanical connector (e.g., such as hinged connector 63), at least one time or composition-activated dissolvable component, or a combination thereof. Although hinged connectors 63 are described herein, such description is for explanatory purposes only and any release mechanism including, without limitation, any mechanical, hydraulic, electric, magnetic, or the like, or any combination thereof for controllably releasing plug 10 from housing 50 is contemplated. That is, anchoring mechanism 52 may be any suitable mechanism for temporarily and releasably securing at least one plug 10 at a pre-determined location within the casing string.

In such alternative embodiments, the presently improved cement plug 10 may further comprise at least one retainer tubular 66 configured for providing the at least one temporary anchoring mechanism. Retainer tubular 66 may be operably engaged within plug 10 (e.g., via box and pin joint connection), or it may be manufactured to be integral therewith. For example, in some embodiments, retainer tubular 66 may be operably connected end to end within plug body 12 (14, 16) and nose portion 30, as applicable. Retainer tubular 66 may be 'centrally' disposed within plug 10, i.e., retainer tubular 66 may be positioned uphole of nose portion 30 and downhole of at least one tubulars forming plug body 12 (14, 16). Retainer tubular 66 may comprise a substantially tubular body forming a longitudinal bore 65, bore 65 having a central longitudinal axis $\alpha$.

Figure 13A:
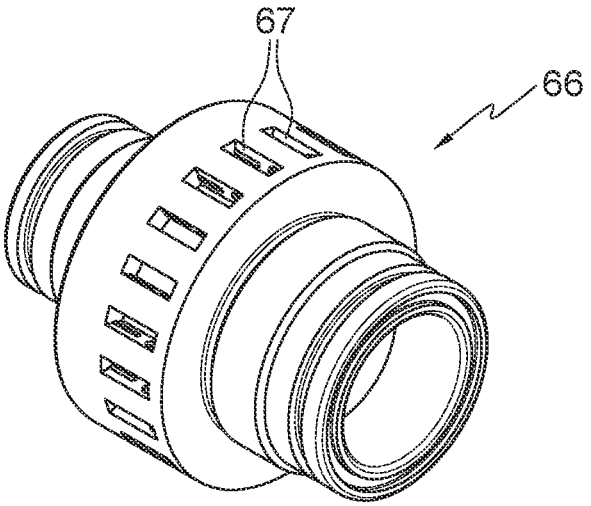
FIGS. 13A and 13B show perspective and side views, respectively, of an alternative retainer tubular configured for retaining the cement plug shown in FIG. 11 within the plug launch housing, according to embodiments.
Figure 13B:
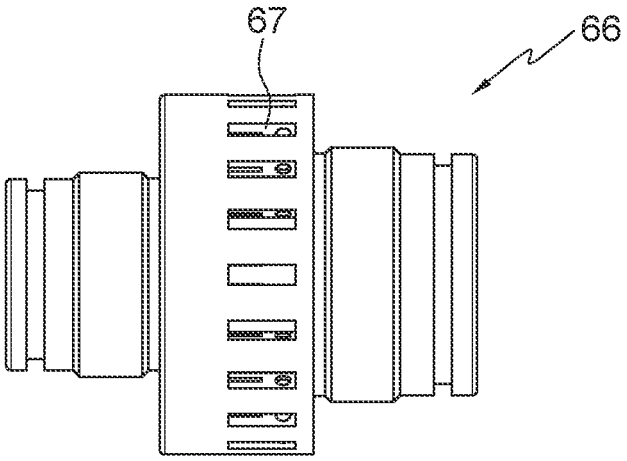

In such alternative embodiments, having regard to FIGS. 13A and 13B, about its outer surface, retainer tubular 66 may form a plurality of longitudinally extending slots, such as pin slots 67 (FIG. 13B), for operably receiving at least one sharable hinge pin 63 (shown in FIGS. 12A and 12B). At least one annular seal may be provided about the outer surface of retainer tubular 66 for sealingly engaging retainer tubular 66 within plug body 12.

As described above, anchoring mechanism may be set to trigger either before or after rupture disc 19. For example, having further regard to FIG. 6B, depending upon desired operating parameters, plug 10 may be configured such that rupture of the at least one burst disc 19 occurs prior to mechanically triggering/releasing plug 10 downhole (i.e., burst disc 19 shown ruptured or, optionally, nonexistent to form a hollow cement plug embodiment 10).

In some embodiments, plug 10 may further comprise a controlled dissolvable portion that, when dissolved, triggers the release of plug 10 downhole. Dissolvable portion may provide for timed or delayed release of cement plug 10 downhole, triggering the release of a new, fresh cement plug 10 downhole while also ensuring full restoration of casing string ID for post-cementing operations. For example, in some embodiments, plug 10 may be manufactured to form a dissolvable material alone, or in combination with a reactive material suitable to enhance the degradation of the dissolvable material (e.g., a catalytic material specifically configured to react with the dissolvable material, as described in U.S. patent application Ser. No. 17/717,435, incorporated entirely herein by reference).

In some embodiments, the at least one cement plugs 10 may be designed to land in or with a CBS positioned at the heel portion of the wellbore, or at any other approximate location within the horizontal portion of the wellbore that might serve to preserve the plug 10 (i.e., fin) characteristics, providing a substantially new, unworn plug mid-way downhole (i.e., at a shorter distance from the toe of the wellbore than the distance from the surface). It is contemplated that the presently improved apparatus and methods of use may provide a modified system for providing at least one cement displacement plug within a casing buoyancy sub, advantageously providing the CDP at any predetermined, target location within the wellbore.

Advantageously, yet counterintuitively, launching and temporarily securing at least one cement plug 10 at least partially within a horizontal portion of the wellbore (e.g., at or near the heel) prior or during cementing operations provides at least one 'fresh', non-worn plug 10 downhole for effective wiping of the lower portion of the horizontal portion of the wellbore, without impeding flow of cement slurry therethrough during the cementing operations and without impending the casing string ID for post-cementing operations. As would be appreciated, such plug(s) 10 each comprise a longitudinal borehole 15 therethrough, permitting fluids to circulate through the plug 10 and supporting required fluid flow rates used during cementing operations.

In some embodiments, plug 10 may travel downhole, cleaning the inner surface of the casing string, until it securely lands in and latches with a conventional landing collar and/or float equipment (e.g., shoe) positioned at the toe of the wellbore. In this manner, the presently improved plug can provide a new, fresh cement plug for enhanced wiping of the casing string, ensuring a restored casing diameter without creating any debris or shearing remnants within the wellbore.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

What is claimed:

1. An apparatus for providing at least one cement plug into a casing string positioned within a subterranean wellbore, the at least one cement plug for wiping the inner surface of a casing string, the apparatus comprising:

at least one housing tubular forming a longitudinal housing bore, the at least one housing tubular operably engaged with the casing string and forming at least one annular stop at at least one predetermined, target location within the longitudinal bore, and the at least one cement plug, the plug having at least one tubular plug body forming a longitudinal plug bore extending therethrough, the tubular plug body having at least one wiper fin mounted about and extending radially outwardly therefrom, and at least one retainer tubular, the retainer tubular forming an anchoring mechanism about its outer surface for corresponding with the annular stop, wherein the at least one cement plug is releasably anchored to the at least one housing tubular to preload the casing string positioned within the subterranean wellbore with the at least one cement plug.

2. The apparatus of claim 1, wherein the at least one cement plug further comprises at least one disc valve sealingly positioned within the longitudinal plug bore.

3. The apparatus of claim 2, wherein the disc valve comprises a dissolvable or burstable valve for temporarily extending substantially across, and preventing fluid flow through, the longitudinal plug bore.

4. The apparatus of claim 1, wherein the at least one wiper fin comprises at least one expansion member configured for biasing the at least one wiper fin radially outwardly and into sealing engagement with the inner surface of the casing string.

5. The apparatus of claim 4, wherein the at least one expansion member forms at least one projection for biasing the at least one wiper fin radially outwardly.

6. The apparatus of claim 1, wherein the at least one plug further comprises one or more fluid nozzles.

7. The apparatus of claim 1, wherein the at least one cement plug further comprises at least one check valve sealingly positioned within the longitudinal plug bore.

8. The apparatus of claim 1, wherein the at least one tubular plug body forms at least one fluid port for venting fluid from the longitudinal plug bore.

9. The apparatus of claim 1, wherein the at least one cement plug further comprises at least one nose portion forming an annular latch ring configured for landing in and latching with downhole equipment or another at least one cement plug.

10. The apparatus of claim 1, wherein the anchoring mechanism may comprises at least one controllably triggered shear mechanism.

11. A method of delivering at least one cement plug into a casing string positioned within a subterranean wellbore, the method comprising:

providing a cement plug launch housing forming at least one stop for releasably retaining the at least one cement plug within the casing string, the cement plug launch housing configured to operably engage and run in hole with the casing string for positioning the at least one cement plug at one or more predetermined, target locations along the casing string, providing the at least one cement plug forming at least one anchoring mechanism for corresponding with the at least one stop of the plug launch housing, positioning the at least one cement plug into the plug launch housing, launching the at least one cement plug into the casing string, preloading the casing string with the at least one cement plug at the one or more predetermined target locations, controllably triggering the anchoring mechanism to release the at least one cement plug from the one or more predetermined locations along the casing string.

12. The method of claim 11, wherein the at least one cement plugs are released from the plug launch housing alone or in series.

13. The method of claim 11, wherein the plug launch housing is retrievably provided at surface of the subterranean wellbore.

14. The method of claim 11, wherein the plug launch housing is provided in a casing buoyancy system.

15. The method of claim 11, wherein the method further comprises rupturing at least one disc valve positioned within the at least one cement plug to reinstate fluid flow through the casing string.

16. The method of claim 15, wherein the rupturing of the at least one disc valve occurs before or after the release of the one or more cement plugs from the predetermined location in the casing string.

17. The method of claim 11, wherein the method comprises providing the at least one cement plug before or; during, or after casing or cementing-operations.

* * * * *